US010307824B2

(12) United States Patent
Kondoh

(10) Patent No.: US 10,307,824 B2
(45) Date of Patent: Jun. 4, 2019

(54) TITANIUM POWDER, TITANIUM MATERIAL, AND METHOD FOR PRODUCING TITANIUM POWDER CONTAINING SOLID-SOLUTED OXYGEN

(71) Applicants: HI-LEX CORPORATION, Hyogo (JP); Katsuyoshi Kondoh, Osaka (JP)

(72) Inventor: Katsuyoshi Kondoh, Osaka (JP)

(73) Assignees: Katsuyoshi Kondoh, Minoh-Shi (JP); HI-LEX CORPORATION, Takarazuka-Shi (JP)

( * ) Notice: Subject to any disclaimer, the term of this patent is extended or adjusted under 35 U.S.C. 154(b) by 501 days.

(21) Appl. No.: 15/110,551

(22) PCT Filed: Dec. 26, 2014

(86) PCT No.: PCT/JP2014/084529
§ 371 (c)(1),
(2) Date: Jul. 8, 2016

(87) PCT Pub. No.: WO2015/105024
PCT Pub. Date: Jul. 16, 2015

(65) Prior Publication Data

US 2016/0332233 A1 Nov. 17, 2016

(30) Foreign Application Priority Data

Jan. 10, 2014 (JP) ..... 2014-003392

(51) Int. Cl.

| | |
|---|---|
| ***B22F 9/16*** | (2006.01) |
| ***B22F 3/20*** | (2006.01) |
| ***C22C 14/00*** | (2006.01) |
| ***B22F 1/00*** | (2006.01) |
| ***B22F 1/02*** | (2006.01) |
| ***C22F 1/02*** | (2006.01) |
| ***C22F 1/18*** | (2006.01) |
| ***C23C 8/10*** | (2006.01) |
| ***C23C 8/80*** | (2006.01) |

(52) U.S. Cl.
CPC ..... *B22F 9/16* (2013.01); *B22F 1/0003* (2013.01); *B22F 1/0085* (2013.01); *B22F 1/02* (2013.01); *B22F 3/20* (2013.01); *C22C 14/00* (2013.01); *C22F 1/02* (2013.01); *C22F 1/183* (2013.01); *C23C 8/10* (2013.01); *C23C 8/80* (2013.01); *B22F 2201/03* (2013.01); *B22F 2201/11* (2013.01); *B22F 2301/205* (2013.01); *B22F 2302/25* (2013.01); *B22F 2998/10* (2013.01); *B22F 2999/00* (2013.01)

(58) Field of Classification Search
CPC ..... B22F 9/16; B22F 1/0003; B22F 1/0085; B22F 1/02; C22C 14/00; C22F 1/02; C22F 1/183; C23C 8/10; C23C 8/80
USPC ..... 75/245
See application file for complete search history.

(56) References Cited

U.S. PATENT DOCUMENTS

| | | | |
|---|---|---|---|
| 6,221,173 | B1 | 4/2001 | Shibuya et al. |
| 2004/0115083 | A1 | 6/2004 | Furuta |

FOREIGN PATENT DOCUMENTS

| | | | |
|---|---|---|---|
| CN | 101254536 | A | 9/2008 |
| CN | 101758221 | A | 6/2010 |
| EP | 3 097 998 | A1 | 11/2016 |
| JP | H05-9703 | A | 1/1993 |
| JP | H07-90318 | A | 4/1995 |
| JP | H08-225802 | A | 9/1996 |
| JP | 2006-342401 | A | 12/2006 |
| JP | 4408184 | B2 | 2/2010 |
| JP | 2012-241241 | A | 12/2012 |
| WO | 2002/077305 | A1 | 10/2002 |

OTHER PUBLICATIONS

International Search Report from corresponding International Application No. PCT/JP2014/084529.
Bin Sun, et al. "Fabrication of highstrength Ti materials by in-process solid solution strengthening of oxygen via P/M methods," Materials Science and Engineering A, Jun. 27, 2012, pp. 1-6.

*Primary Examiner* — Edward M Johnson
(74) *Attorney, Agent, or Firm* — Hauptman Ham, LLP

(57) ABSTRACT

A method for producing titanium powder containing a solid-soluted oxygen comprises the steps of: heating titanium powder comprised of titanium particles in an oxygen-containing atmosphere in a temperature range of 160° or higher and less than 600° C. to form a titanium oxide layer on the surface of the titanium particle; and heating the titanium powder having the titanium oxide layer in an oxygen-free atmosphere in a temperature range of 450° C. or higher and a melting point of the titanium oxide layer or lower to decompose the titanium oxide layer on the surface of the titanium particle so that oxygen atoms dissociated form a solid solution in a matrix of the titanium particle.

20 Claims, 6 Drawing Sheets

RELATIONSHIP BETWEEN OXYGEN CONTENT % (ABSCISSA) AND TENSILE STRENGTH MPa (ORDINATE)

RELATIONSHIP BETWEEN OXYGEN CONTENT % (ABSCISSA) AND YIELD STRENGTH MPa (ORDINATE)

TITANIUM POWDER, TITANIUM MATERIAL, AND METHOD FOR PRODUCING TITANIUM POWDER CONTAINING SOLID-SOLUTED OXYGEN

TECHNICAL FIELD

The present invention relates to titanium powder and titanium materials, and more particularly to titanium powder strengthened by a solid solution of oxygen in titanium, titanium materials, and methods for producing such a strengthened titanium powder and a titanium material.

BACKGROUND ART

Titanium is a lightweight material whose specific gravity is as low as about half that of steel and which is characterized by its high corrosion resistance and high strength. Titanium is therefore used for parts of aircrafts, railway vehicles, two-wheeled vehicles, automobiles, etc. for which reduction in weight is greatly desired, home appliances, members for construction, etc. Titanium is also used as a material for medical use because of its high corrosion resistance.

However, applications of titanium are limited due to its high material cost, as compared to iron and steel materials and aluminum alloys. In particular, titanium alloys have tensile strength as high as more than 1,000 MPa, but do not have enough ductility (elongation at break). Moreover, titanium alloys have poor plastic workability at normal temperature or in a low temperature range. Pure titanium has elongation at break as high as more than 25% at normal temperature and has excellent plastic workability in a low temperature range. However, pure titanium has tensile strength as low as about 400 to 600 MPa.

Various studies have been carried out in response to a very strong need for titanium having both high strength and high ductility and for reduction in material cost of titanium. In particular, many techniques of strengthening titanium by using relatively inexpensive elements such as oxygen rather than expensive elements such as vanadium, scandium, and niobium have been studied as related art in order to achieve cost reduction.

For example, Japanese Unexamined Patent Application Publication No. 2012-241241 (Patent Literature 1) proposes the following steps as a method for producing a solid solution of oxygen in titanium material.

(a) preparing titanium powder and $TiO_2$ particles;

(b) mixing the titanium powder and the $TiO_2$ particles so that the mixture contains 0.5 to 3.0 mass % of $TiO_2$ particles; and (c) sintering the mixture in a vacuum atmosphere in the temperature range from 700° C. to a temperature lower than the melting point of $TiO_2$ to thermally decompose the $TiO_2$ particles so that oxygen atoms dissociated form a solid solution with titanium.

CITATION LIST

Patent Literature

PTL 1; Japanese Unexamined Patent Application Publication No. 2012-241241

SUMMARY OF INVENTION

Technical Problem

The titanium material produced by the method disclosed in Japanese Unexamined Patent Application Publication No. 2012-241241, namely a powder metallurgy process using $TiO_2$ particles, can maintain higher strength and higher ductility as compared to materials produced by melting methods.

However, further studies conducted by the inventors have shown that this method still has room for improvement. $TiO_2$ particles tend to agglomerate due to their small grain size. Specifically, if the amount of $TiO_2$ particles is increased, $TiO_2$ is not completely decomposed due to agglomeration of the $TiO_2$ particles, and the remaining $TiO_2$ particles serve as a starting point of fracture, causing reduction in ductility.

In view of the above, in the powder metallurgy process using $TiO_2$ particles, there is an upper limit on the amount of $TiO_2$ particles that can be added, namely there is an upper limit on the amount of oxygen that can be contained in a solid solution, in order to maintain appropriate ductility.

It is an object of the present invention to provide a method for producing titanium powder, which allows a large amount of oxygen to be contained in the solid solution and maintains appropriate ductility.

It is another object of the present invention to provide titanium powder and titanium materials which contain a large amount of solid-soluted oxygen and maintain appropriate ductility.

Solution to Problem

A method for producing titanium powder containing a solid-soluted oxygen according to the present invention comprise the steps of;

(a) heating the titanium powder comprised of titanium particles in an oxygen-containing atmosphere to form a titanium oxide layer on a surface of the titanium particle; and (b) heating the titanium powder having the titanium oxide layer in an oxygen-free atmosphere to decompose the titanium oxide layer on the surface of the titanium particle so that oxygen atoms thus dissociated form a solid solution in a matrix of the titanium particle.

Preferably, a cycle consisting of formation of the titanium oxide layer and subsequent decomposition of the titanium oxide layer is repeated a plurality of times to increase an oxygen content in the solid solution in the matrix of the titanium particle.

A heating temperature for forming the titanium oxide layer is preferably 160° C. or higher and less than 600° C., and a heating temperature for decomposing the titanium oxide layer is preferably 450° C. or higher and a melting point of the titanium oxide layer or less.

The heat treatment for forming the titanium oxide layer and for decomposing the titanium oxide layer is preferably performed by placing the titanium powder in a rotary kiln furnace.

The titanium powder containing a solid-soluted oxygen produced by the method according to any one of the above aspects is characterized in that each of the titanium particles has on its surface an oxide layer naturally formed in an atmosphere, and the oxygen content in the solid solution in the matrix of the titanium particles is higher than that in the naturally formed oxide layer.

Preferably, the titanium particle contains preferably 0.4 to 4.7 mass % of oxygen, and more preferably 1.15 to 1.9 mass % of oxygen.

In one embodiment, the titanium particle forming the titanium powder is made of pure titanium, and an average value of micro Vickers hardness of the matrix of the titanium particle is 200 to 600.

The present invention is also directed to a titanium material compacted into a predetermined shape by using the titanium powder containing the solid-soluted oxygen according to any one of the above aspects. In one embodiment, the titanium material is an extruded material produced from pure Ti powder, and the extruded material contains 1.2 mass % or more of oxygen and has elongation at break of 18% or more.

Examples of a method for compacting the titanium powder to produce the titanium material include powder compaction and sintering, hot extrusion, hot rolling, thermal spraying, metal injection molding, powder additive manufacturing, etc.

Functions and effects or technical significance of the above characteristic configuration will be described in the following sections.

DESCRIPTION OF EMBODIMENTS

Figure 1:
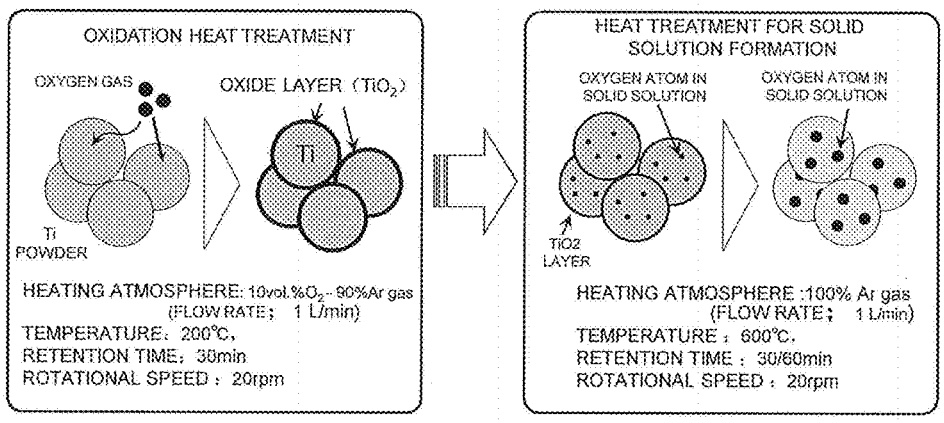
FIG. 1 is a diagram schematically showing characteristics of the present invention.

FIG. 1 is a diagram schematically showing characteristics of the present invention. First, the outline of the present invention will be described with reference to FIG. 1, and more detailed data etc. will be described thereafter.

[Preparation of Titanium Powder Material]

A titanium powder comprised of a multiplicity of titanium particles is prepared. As used herein, the "titanium particles" may be either pure titanium particles or titanium alloy particles. Each titanium particle has on its surface an oxide layer naturally formed in the atmosphere (natural oxide layer). However, since the natural oxide layer is a very thin layer, it is not shown in FIG. 1. The thickness of the natural oxide layer is about 0.1 to 1 μm.

[Formation of Titanium Oxide Layer]

The prepared titanium powder is heated in an oxygen-containing atmosphere to form a titanium oxide layer on the surface of each titanium particle. The heat treatment for forming the titanium oxide layer is preferably performed by placing the titanium powder in a rotary kiln furnace. For example, heating conditions are as follows.

Heating atmosphere: mixed gas of 10 vol % $O_2$ and 90 vol % Ar

Gas flow rate: 1 L/min

Heating temperature: 200° C.

Retention time: 30 min

Rotational speed: 20 rpm

A titanium oxide layer is formed on the surface of each titanium particle by this oxidation heat treatment. The rotary kiln furnace is used in order to prevent the titanium particles from being temporarily sintered to agglomerate in the oxidation heat treatment by rotating and vibrating the titanium powder. The argon gas is used in order to prevent abnormal heat generation of the titanium powder due to excess oxygen.

[Heat Treatment for Solid Solution Formation]

The titanium powder having the titanium oxide layer on its surface is heated in an oxygen-free atmosphere to decompose the titanium oxide layer on the surface of each titanium particle so that oxygen atoms dissociated form a solid solution in a matrix of each titanium particle. The heat treatment for decomposing the titanium oxide layer is preferably performed by placing the titanium powder in a rotary kiln furnace. The oxidation heat treatment and the heat treatment for solid solution formation may be performed by using the same rotary kiln furnace. For example, heating conditions are as follows.

Heating atmosphere: 100 vol % Ar gas

Gas flow rate: 1 L/min

Heating temperature: 600° C.

Retention time: 30 min or 60 min

Rotational speed: 20 rpm

By this heat treatment for solid solution formation, the oxygen atoms produced by decomposition of the titanium oxide layer are uniformly diffused in the matrix of each titanium particle to form a solid solution. An intended solid solution of oxygen in the titanium powder can be produced.

By placing the titanium powder containing the solid-soluted oxygen produced in the atmosphere, a natural oxide layer is formed on the surface of each titanium particle. The oxygen content in the natural oxide layer on each titanium particle is at most about 0.2 mass %. By performing the oxidation heat treatment and the heat treatment for solid solution formation by the method of the present invention, the oxygen content in the solid solution in the matrix of each titanium particle is higher than that in the natural oxide layer.

[Repetition of Oxidation Heat Treatment and Heat Treatment for Solid Solution Formation]

The oxygen content in the solid solution does not increase even if the time for the oxidation heat treatment is increased. This is because the titanium oxide layer formed on the surface of each titanium particle serves as a barrier and the oxidation reaction does not proceed any further. In order to increase the oxygen content in the solid solution in the matrix of each titanium particle, it is desirable to repeat a cycle including of the oxidation heat treatment for forming a titanium oxide layer and the subsequent heat treatment for solid solution formation for decomposing the titanium oxide layer a plurality of times, rather than to increase the time for the oxidation heat treatment.

[Examination with Diffraction Peaks]

Figure 2:
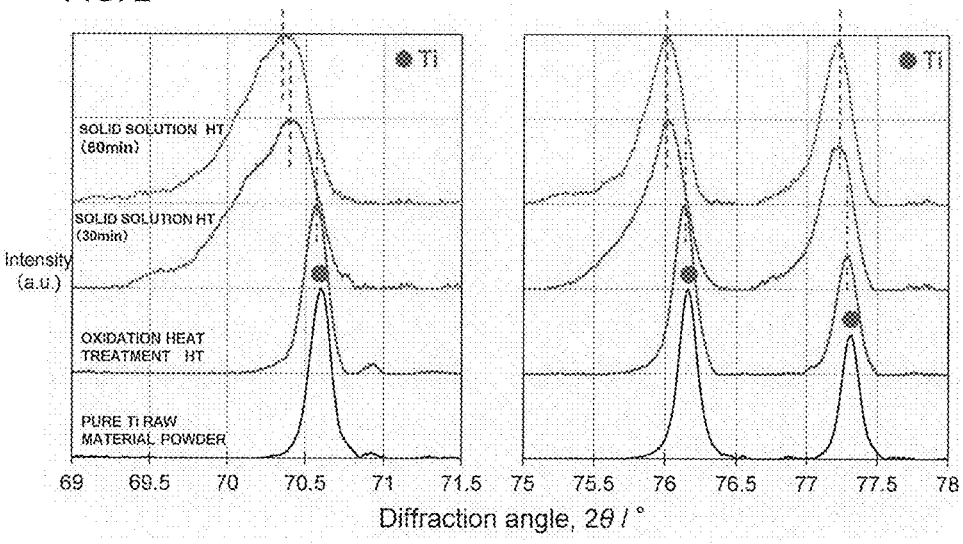
FIG. 2 is a diagram showing diffraction peak shifts of Ti caused by performing oxidation heat treatment and heat treatment for solid solution formation on pure titanium raw material powder.

FIG. 2 shows diffraction peak shifts of Ti caused by performing the oxidation heat treatment and the heat treatment for solid solution formation on pure titanium raw material powder. As can be seen from FIG. 2, diffraction peaks of Ti are shifted to lower angle side when pure titanium raw material powder is subjected to the oxidation heat treatment, and are shifted to significantly lower angle side when the pure titanium raw material powder is further subjected to the heat treatment for solid solution formation. These peak shifts show that a solid solution of oxygen atoms in a Ti base material (matrix) was formed. This shows that, in the oxidation heat treatment, a large number of oxygen atoms contribute to formation of the titanium oxide layer and only a small number of oxygen atoms are contained in a solid solution in the Ti base material. Further, in the heat treatment for solid solution formation, the titanium oxide layer is decomposed and a large number of oxygen atoms are contained in the solid solution in the Ti base material.

Figure 3:
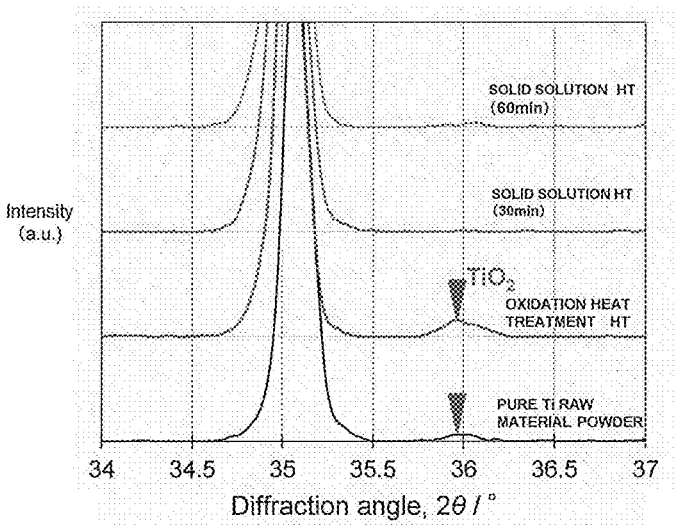
FIG. 3 is a diagram showing a change in diffraction peak of $TiO_2$ caused by performing oxidation heat treatment and heat treatment for solid solution formation on pure titanium raw material powder.

FIG. 3 shows a change in diffraction peak of $TiO_2$ caused by performing the oxidation heat treatment and the heat treatment for solid solution formation on pure titanium raw material powder. There is a low diffraction peak of $TiO_2$ detected in the pure titanium raw material powder. This is because the pure titanium raw material powder has an oxide layer naturally formed in the atmosphere (natural oxide layer). Since a titanium oxide layer is formed on the surface of each powder particle by the oxidation heat treatment, the peak intensity of $TiO_2$ is increased as a result of the oxidation heat treatment. Since the titanium oxide layer is thermally decomposed and oxide atoms are contained in the solid solution in the Ti base material in the heat treatment for solid solution formation, the peak of $TiO_2$ disappears as a result of the heat treatment for solid solution formation.

[Method for Increasing Content of Oxygen Atoms in Solid Solution in Matrix of Each Titanium Particle]

A cycle including of the oxidation heat treatment and the heat treatment for solid solution formation under the following conditions was repeated four times, and the oxygen and nitrogen contents in pure titanium powder were measured. The pure titanium powder used had an average grain size of 28 μm and purity of higher than 95%.

Oxidation Heat Treatment

Heating atmosphere: mixed gas of 10% $O_2$ and 90% Ar (flow rate: 1 L/min)

Heating temperature: 200° C.

Retention time: 30 min

Rotational speed: 20 rpm

Heat Treatment for Solid Solution Formation

Heating atmosphere: 100% Ar gas (flow rate: 1 L/min)

Heating temperature: 600° C.

Retention time: 30 min

Rotational speed: 20 rpm

Figure 4:
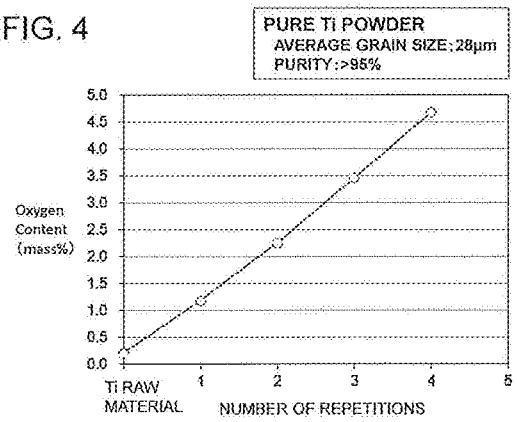
FIG. 4 is a diagram showing a change in oxide content caused by repeating a cycle consisting of oxidation heat treatment and heat treatment for solid solution formation a plurality of times.

The measurement result is shown in Table 1 and FIG. 4. The oxygen and nitrogen contents in the pure titanium powder before heat treatment are shown in the column of "0" for the number of repetitions. This oxygen content is mainly the oxygen content in the natural oxide layer.

TABLE 1

| (Mass %) | 0 | 1 | 2 | 3 | 4 |
|---|---|---|---|---|---|
| Oxygen Content | 0.20 | 1.18 | 2.25 | 3.46 | 4.68 |
| Nitrogen Content | 0.021 | 0.025 | 0.023 | 0.026 | 0.024 |

As shown in Table 1 and FIG. 4, the oxygen content linearly increased substantially in proportion to the number of repeated cycles, but the nitrogen content did not change and was constant. The oxygen content in each titanium powder particle increased to around 4.7% by repeating the cycle four times.

[Measurement of Micro Vickers Hardness]

Pure titanium raw material powder was subjected to the oxidation heat treatment and then to the heat treatment for solid solution formation in order to measure how micro Vickers hardness (Hv) changed. The samples measured were those subjected to a single cycle of the oxidation heat treatment and the heat treatment for solid solution formation and having an oxygen content of 1.18 mass % after the heat treatment for solid solution formation.

Figure 5:
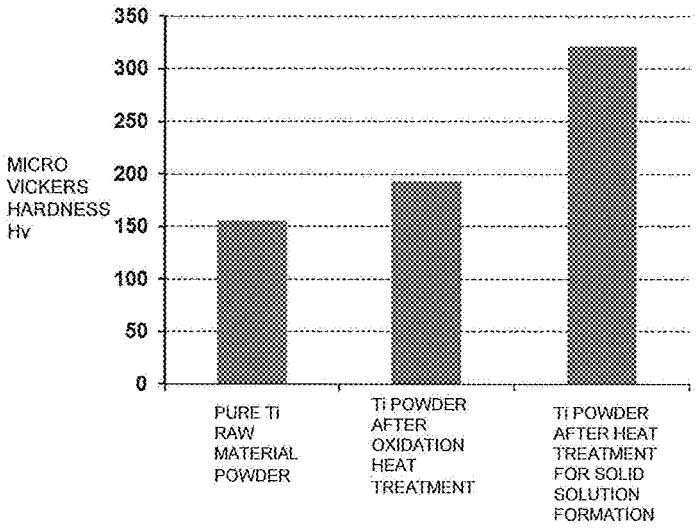
FIG. 5 is a diagram showing a change in micro Vickers hardness caused by performing oxidation heat treatment and heat treatment for solid solution formation on pure titanium raw material powder.

The measurement result is shown in Table 2 and FIG. 5. The number of measurements n was 30.

TABLE 2

| (Number of Measurements n = 30) | AVG | MAX | MIN |
|---|---|---|---|
| Pure Ti Raw Material Powder | 156 | 189 | 191 |
| Ti Powder after Oxidation Heat Treatment | 193 | 311 | 115 |
| Ti Powder after Heat Treatment for Solid Solution Formation | 322 | 508 | 154 |

* Oxygen Content: 1.18 mass %

The measurement result of Table 2 and FIG. 5 shows that micro Vickers hardness markedly increased by performing the oxidation heat treatment and the heat treatment for solid solution formation on the pure Ti raw material powder. A $TiO_2$ layer was formed on the surface of the powder by the oxidation heat treatment. However, since a part of oxygen formed a solid solution with the base material by the oxidation heat treatment, the hardness was increased by about 37 Hv. The $TiO_2$ layer was then decomposed by the heat treatment for solid solution formation. Since oxygen atoms dissociated entered the Ti base material in the solid solution, the hardness was increased by about 130 Hv. Combining the oxidation heat treatment and the heat treatment for solid solution formation thus allows a large number of oxygen atoms to be contained in the solid solution, and therefore significantly increases the base material hardness of the titanium powder.

Increasing the number of repeated cycles of the oxidation heat treatment and the heat treatment for solid solution formation increases the oxygen content in Ti powder. For example, in the case where the number of repeated cycles N is 2 under the same heat treatment conditions, the average value of the base material hardness of pure Ti powder (oxygen content: 2.25 mass %) after the heat treatment for solid solution formation was 498 Hv. Namely, the base material hardness was significantly increased. Similarly, the average value of the base material hardness for N=3 was 643 Hv. However, very hard Ti powder whose base material hardness is higher than 600 Hv requires a large pressing force when powder compaction is performed. Moreover, the powder becomes brittle and therefore cracks develop in the powder compact. Accordingly, a satisfactory compact cannot be produced.

The hardness of pure Ti powder subjected to the oxidation heat treatment and the heat treatment for solid solution formation according to the present invention is 200 to 600 Hv.

EXAMPLE 1

Pure Ti powder (average grain size: 28 μm, purity: >95%) was used as a starting material. A cycle consisting of the oxidation heat treatment and the heat treatment for solid solution formation shown below was repeated up to four times to produce a solid solution of oxygen in the pure Ti powder.

Oxidation Heat Treatment

Atmosphere: mixed gas of 10% $O_2$ and 90% Ar

Temperature: 200° C.

Retention time: 15 min

Rotational speed: 20 rpm

Heat Treatment for Solid Solution Formation

Atmosphere: 100% Ar gas

Temperature: 600° C.

Retention time: 30 min

Rotational speed: 20 rpm

After a die was filled with each Ti powder, a pressure of 600 MPa was applied to produce a columnar powder compact. Thereafter, vacuum sintering (800° C. for 1 hr, degree of vacuum: 6 Pa) was performed to produce a sintered body (diameter φ: 42 mm, total length: 30 mm). The sintered body was preheated in an argon gas atmosphere (1000° C. for 5 min) and then immediately hot-extruded to produce a rod-like extruded material (diameter φ: 7 mm) of the solid solution of oxygen atoms in the Ti powder.

As a comparative material, up to 2.5 mass % of $TiO_2$ particles (average grain size: 4 μm) was added to the same pure Ti powder as that described above, and the $TiO_2$ particles and the pure Ti powder were mixed together. Thereafter, each Ti—$TiO_2$ mixed powder was compacted, vacuum-sintered, and hot-extruded under the same conditions as those described above to produce a rod-like extruded material (diameter φ: 7 mm) of a solid solution of oxygen atoms in the Ti—$TiO_2$ mixed powder.

Figure 6:
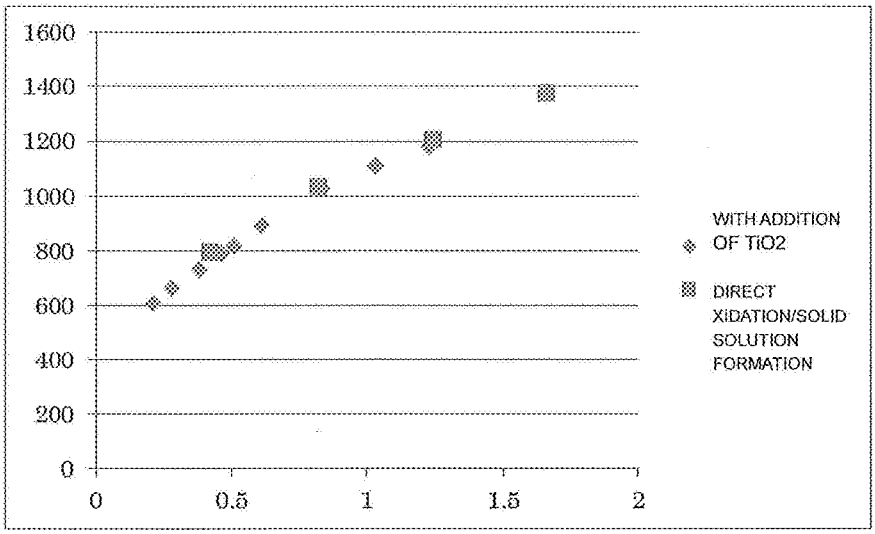
FIG. 6 is a diagram showing the relationship between the oxygen content and the tensile strength.
Figure 7:
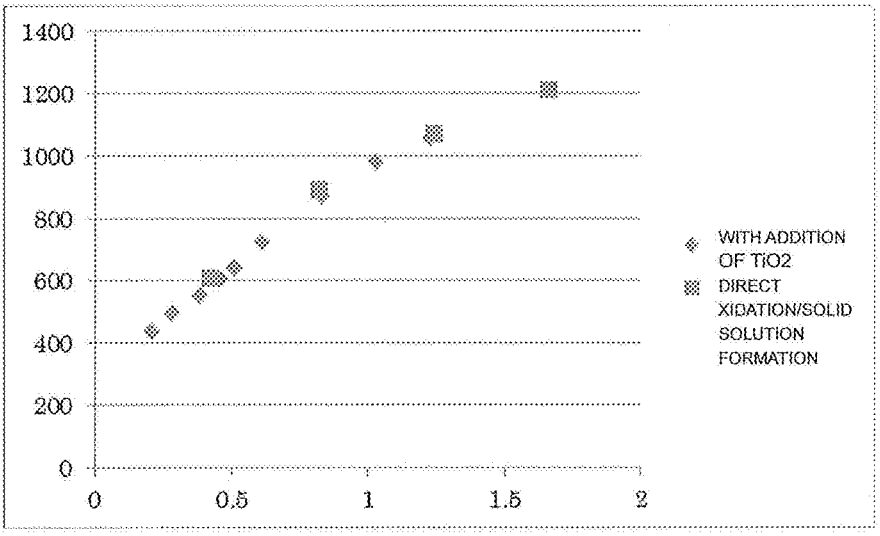
FIG. 7 is a diagram showing the relationship between the oxygen content and the yield strength.

The oxygen content in each extruded material was analyzed, and a tensile test was carried out at normal temperature to measure tensile strength, yield strength and elongation at break in order to find out dependence on the oxygen content. The measurement result is shown in Table 3. Comparison of the tensile strength is shown in FIG. 6, and comparison of the yield strength is shown in FIG. 7.

TABLE 3

(a) Extruded materials produced from pure Ti powder by direct oxidation/solid solution formation heat treatment

| Oxygen Content | 0.21 | 0.42 | 0.82 | 1.24 | 1.66 |
|---|---|---|---|---|---|
| UTS/MPa | 609 | 792 | 1033 | 1208 | 1378 |
| YS/MPa | 438 | 611 | 892 | 1069 | 1213 |
| ε/% | 26.9 | 25.5 | 23.3 | 20.5 | 18.1 |

(b) Extruded materials produced from pure Ti powder with addition of TiO2 particles

| TiO2 additive amount | 0 | 0.2 | 0.4 | 0.6 | 0.8 | 1 | 1.5 | 2 | 2.5 |
|---|---|---|---|---|---|---|---|---|---|
| Oxygen Content | 0.21 | 0.28 | 0.38 | 0.46 | 0.51 | 0.61 | 0.83 | 1.03 | 1.23 |
| UTS/MPa | 609 | 662 | 729 | 789 | 815 | 893 | 1026 | 1107 | 1182 |
| YS/MPa | 438 | 498 | 554 | 607 | 642 | 725 | 873 | 980 | 1059 |
| ε/% | 26.9 | 26.2 | 25.7 | 25.3 | 24.5 | 23.4 | 15.5 | 7.7 | 4.2 |

According to the production method (direct oxidation/solid solution formation heat treatment) of the present invention, both the tensile strength (UTS) and the yield strength (YS) increased substantially linearly with an increase in oxygen content. Although the elongation at break (e) decreased gradually with an increase in oxygen content, but sufficiently satisfactory ductility as high as 18.1% was exhibited for the oxygen content of 1.66 mass %. In Table 3, the samples with an oxygen content of 0.21 mass % are extruded materials made of pure titanium particles with no solid solution formation of oxygen in titanium powder, which means that the natural oxide layer formed on the surface of each particle has an oxygen content of about 0.21 mass %. The samples subjected to the direct oxidation/solid solution formation heat treatment have an oxygen content of 0.42% or higher.

According to the method for forming a solid solution of oxygen in Ti powder with addition of $TiO_2$ particles, both the tensile strength (UTS) and the yield strength (YS) increased with an increase in oxygen content, and the values of the tensile strength (UTS) and the yield strength (YS) were approximately the same as those of the extruded materials of the solid solution of oxygen in the pure Ti powder produced by the production method (direct oxidation/solid solution formation heat treatment) of the present invention. However, the elongation at break (e) sharply decreased for the oxygen contents higher than 1 mass %, and e was 4.2% for the oxygen content of 1.23 mass %. Significantly reduced ductility was exhibited for the oxygen contents higher than 1 mass %.

For the extruded material with an oxygen content of 1.24 mass % out of the extruded materials produced from pure Ti powder by the direct oxidation/solid solution formation heat treatment, and the extruded material with an oxygen content of 1.23 mass % out of the extruded materials produced from pure Ti powder with addition of $TiO_2$ particles, a starting point of fracture in the fracture surface after the tensile test was observed with a scanning electron microscope (SEM). The SEM images are shown in FIG. 8.

Figure 8:
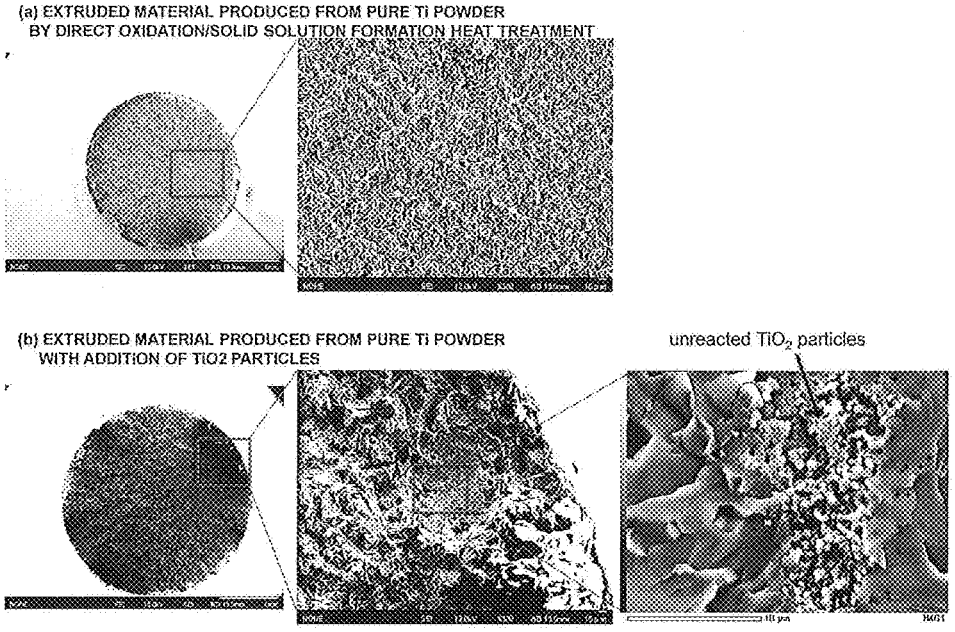
FIG. 8 shows scanning electron microscope images showing fracture surfaces after a tensile test of extruded materials produced from pure Ti powder.

As shown in FIG. 8, both of the extruded materials have substantially the same oxygen content but have significantly different fracture surfaces. The extruded material produced by the direct oxidation/solid solution formation heat treatment had a uniform ductile fracture surface with fine dimples. However, the extruded material produced with addition of $TiO_2$ particles had unreacted $TiO_2$ particles at the starting point of fracture. Namely, since the $TiO_2$ particles agglomerated in the state of the Ti—$TiO_2$ mixed particles, the unreacted $TiO_2$ served as a starting point of fracture, causing significant reduction in elongation at break.

EXAMPLE 2

The influence of the heating temperature of the oxidation heat treatment was examined. Pure Ti powder similar to that used above was used in this example. With oxygen-argon mixed gas (10% $O_2$ and 90% Ar, flow rate: 1 L/min) being introduced into a rotary kiln furnace, 50 g of Ti powder was heated at various heating temperatures in the range of 100 to 700° C. to produce Ti powder. In this oxidation heat treatment, the retention time at each temperature was 1 hour, and the rotational speed was 20 rpm.

The oxygen content and the appearance (agglomeration, formation of a block) of each Ti powder thus produced were examined. The result is shown in Table 4.

TABLE 4

| | Raw Material | Oxidation Heat Treatment Temperature (° C.) 100 | 120 | 140 | 160 | 180 | 200 | 220 | 240 |
|---|---|---|---|---|---|---|---|---|---|
| Oxygen Content (mass %) | 0.21 | 0.36 | 0.64 | 1.02 | 1.17 | 1.15 | 1.16 | 1.19 | 1.14 |
| Appearance | Powder | Powder | Powder | Powder | Powder | Powder | Powder | Powder | Powder |
| | Oxidation Heat Treatment Temperature (° C.) 300 | 350 | 400 | 450 | 500 | 550 | 600 | 650 | 700 |
| Oxygen Content (mass %) | 1.15 | 1.19 | 1.16 | 1.13 | 1.21 | 1.17 | 1.94 | 2.32 | 2.16 |
| Appearance | Powder | Powder | Powder | Powder | Powder | Powder | agglomerated partial melting | agglomerated partial melting | agglomerated partial melting |

Figure 9:
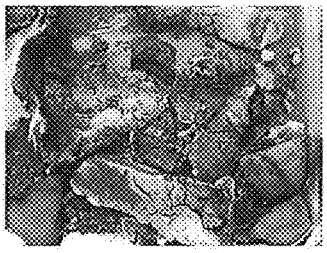
FIG. 9 is an image showing the state where a part of Ti powder particles has melted and agglomerated.

As shown in Table 4, for the heat treatment temperatures of 160° C. or higher, the oxygen content in the Ti powder was constant. Stable oxidation treatment can be performed at such heat treatment temperatures. For the heat treatment temperature of 600° C., as shown by the image in FIG. 9, the temperature excessively rose due to the heat of the heat treatment and the heat generated by oxidation, whereby a part of the Ti powder particles melted and agglomerated. Accordingly, intended Ti powder cannot be produced at this heat treatment temperature. A similar partial melting phenomenon was observed for the heat treatment temperatures of 650° C. and 750° C.

The above result shows that the temperature range suitable for the oxidation heat treatment of Ti powder is 160° C. or higher, and the oxidation heat treatment at less than 600° C. is effective in restraining partial melting of Ti powder.

Figure 10:
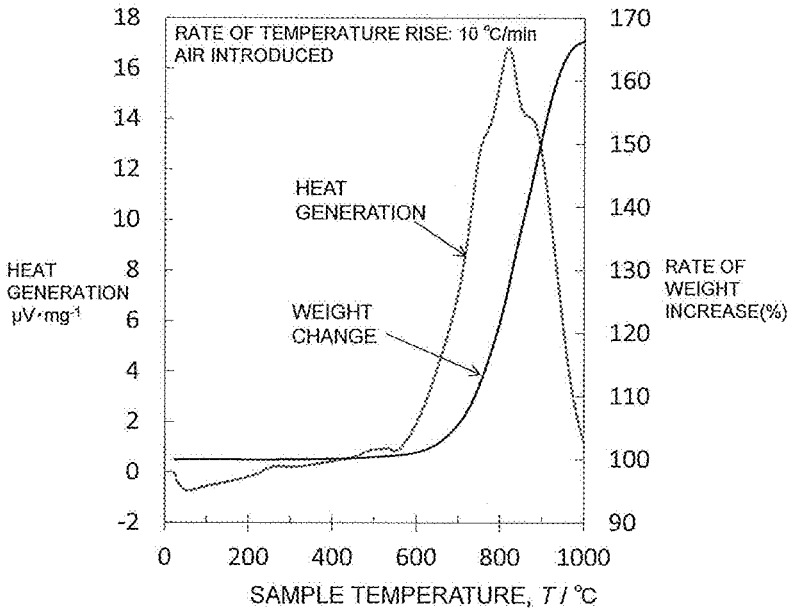
FIG. 10 is a diagram showing the relationship among the sample temperature, the heat generation and the rate of weight increase.

A change in weight of the Ti powder and the exothermic behavior of the Ti powder were examined by using a differential thermal analyzer (DTA) with air being introduced therein. As shown in FIG. 10, the weight sharply increased at around 600° C. This is due to the reaction with oxygen (oxidation). The amount of heat generation also sharply increased at around 600° C. due to the exothermic phenomenon associated with the oxidation reaction. In view of the above differential thermal analysis result, the heat treatment need be performed at less than 600° C. in order to facilitate a stable oxidation reaction. Performing the heat treatment at 600° C. or higher would form a block of Ti powder due to the partial melting phenomenon, and therefore an intended solid solution of oxygen in Ti powder would not be produced.

EXAMPLE 3

The influence of the heating temperature of the heat treatment for solid solution formation was examined. The oxidation heat treatment was similarly performed on pure Ti powder under the following conditions.

Heating atmosphere: mixed gas of 10% $O_2$ and 90% Ar (flow rate: 1 L/min)

Heating temperature: 200° C.

Retention time: 30 min

Rotational speed: 20 rpm

Thereafter, the heat treatment for solid solution formation was performed with a rotary kiln furnace in an argon gas atmosphere at various heating temperatures in the range of 300 to 800° C. to produce Ti powder. In the heat treatment for solid solution formation, the retention time at each temperature was 1 hour, the flow rate of argon gas was 1 L/min, and the rotational speed was 20 rpm.

In the heat treatment for solid solution formation, two different weights of Ti powder, namely 30 g and 150 g, were placed into the furnace at a time in order to examine the influence of the amount of Ti powder placed into the furnace for the heating treatment.

XRD of the resultant Ti powder was used to examine existence of a $TiO_2$ peak and Ti peak shifts (shifts to lower angles). The result is shown in Table 5.

TABLE 5

| | Solid Solution Formation Heat Treatment Temperature none | 300° C. | 350° C. | 400° C. | 450° C. | 500° C. | 550° C. | 600° C. | 650° C. | 700° C. | 750° C. | 800° C. |
|---|---|---|---|---|---|---|---|---|---|---|---|---|
| Amount of Ti Powder: 30 g | | | | | | | | | | | | |
| TiO2 Peak | Present | Present | Present | Present | No | No | No | No | No | No | No | No |
| Ti Peak Shifts | No | No | No | Slight | Present | Present | Present | Present | Present | Present | Present | Present |
| Amount of Ti Powder: 150 g | | | | | | | | | | | | |
| TiO2 Peak | Present | Present | Present | Present | Low Peak | Low Peak | No | No | No | No | No | No |
| Ti Peak Shifts | No | No | No | Slight | Present | Present | Present | Present | Present | Present | Present | Present |

As shown in Table 5, the heat treatment need be performed at 450° C. or higher in order to thermally decompose an oxide layer $TiO_2$ formed by the oxidation heat treatment and allow oxygen atoms to form a solid solution with a Ti base material. In particular, in the case where a larger amount of Ti powder is placed into the furnace for the heat treatment, the heat treatment at higher temperatures, namely 550° C. or higher, is desirable in order to allow oxygen atoms to stably, uniformly, and completely form a solid solution with the Ti base material.

INDUSTRIAL APPLICABILITY

The present invention can be advantageously used to produce titanium powder and a titanium material having high strength and appropriate ductility by a solid solution containing a large amount of oxygen.

The invention claimed is:

1. A method for producing titanium powder containing a solid-soluted oxygen, the method comprising:

heating a titanium powder comprising titanium particles in an oxygen-containing atmosphere to form a titanium oxide layer on a surface of each of titanium particles; and heating the titanium powder having the titanium oxide layer in an oxygen-free atmosphere to decompose the titanium oxide layer on the surface of the titanium particle so that oxygen atoms dissociated form a solid solution in a matrix of the titanium particle.

2. The method for producing titanium powder containing a solid-soluted oxygen according to claim 1, wherein a cycle including the formation of the titanium oxide layer and the subsequent decomposition of the titanium oxide layer is repeated a plurality of times to increase an oxygen content to be a solid solution in the matrix of the titanium particle.

3. The method for producing titanium powder containing a solid-soluted oxygen according to claim 1, wherein a heating temperature for forming the titanium oxide layer is 160° C. or higher and less than 600° C., and a heating temperature for decomposing the titanium oxide layer is 450° C. or higher and a melting point of the titanium oxide layer or less.

4. The method for producing titanium powder containing a solid-soluted oxygen according to claim 1, wherein the heat treatment for forming the titanium oxide layer and for decomposing the titanium oxide layer is performed by placing the titanium powder in a rotary kiln furnace.

5. A titanium powder comprising titanium particles containing a solid-soluted oxygen produced by the method according to claim 1, wherein at least one of the titanium particles has on its surface an oxide layer naturally formed in an atmosphere, and the oxygen content in the solid solution in the matrix of the at least one titanium particle is higher than that in the naturally formed oxide layer.

6. The titanium powder containing a solid-soluted oxygen according to claim 5, wherein the titanium particle contains 0.4 to 4.7 mass % of oxygen.

7. The titanium powder containing a solid-soluted oxygen according to claim 6, wherein the titanium particle contains 1.15 to 1.9 mass % of oxygen.

8. The titanium powder containing a solid-soluted oxygen according to claim 5, wherein the titanium particle is made of pure titanium, and an average value of micro Vickers hardness of the matrix of the titanium particle is 200 to 600.

9. A titanium material compacted into a predetermined shape by using the titanium powder containing a solid-soluted oxygen according to claim 5.

10. The titanium material according to claim 9, wherein the titanium material is an extruded material produced from pure Ti powder, the extruded material contains 1.2 mass % or more of oxygen, and the extruded material has elongation at break of 18% or more.

11. The method for producing titanium powder containing a solid-soluted oxygen according to claim 2, wherein a heating temperature for forming the titanium oxide layer is 160° C. or higher and less than 600° C., and a heating temperature for decomposing the titanium oxide layer is 450° C. or higher and a melting point of the titanium oxide layer or less.

12. The method for producing titanium powder containing a solid-soluted oxygen according to claim 2, wherein the heat treatment for forming the titanium oxide layer and for decomposing the titanium oxide layer is performed by placing the titanium powder in a rotary kiln furnace.

13. A titanium powder comprising titanium particles containing a solid-soluted oxygen produced by the method according to claim 2, wherein at least one of the titanium particles has on its surface an oxide layer naturally formed in an atmosphere, and the oxygen content in the solid solution in the matrix of the at least one titanium particle is higher than that in the naturally formed oxide layer.

14. The method for producing titanium powder containing a solid-soluted oxygen according to claim 3, wherein the heat treatment for forming the titanium oxide layer and for decomposing the titanium oxide layer is performed by placing the titanium powder in a rotary kiln furnace.

15. A titanium powder comprising titanium particles containing a solid-soluted oxygen produced by the method according to claim 3, wherein at least one of the titanium particles has on its surface an oxide layer naturally formed in an atmosphere, and the oxygen content in the solid solution in the matrix of the at least one titanium particle is higher than that in the naturally formed oxide layer.

16. A titanium powder comprising titanium particles containing a solid-soluted oxygen produced by the method according to claim 4, wherein at least one of the titanium particles has on its surface an oxide layer naturally formed in an atmosphere, and the oxygen content in the solid solution in the matrix of the at least one titanium particle is higher than that in the naturally formed oxide layer.

17. The titanium powder containing a solid-soluted oxygen according to claim 6, wherein the titanium particle is made of pure titanium, and an average value of micro Vickers hardness of the matrix of the titanium particle is 200 to 600.

18. A titanium material compacted into a predetermined shape by using the titanium powder containing a solid-soluted oxygen according to claim 6.

19. The titanium powder containing a solid-soluted oxygen according to claim 7, wherein the titanium particle is made of pure titanium, and an average value of micro Vickers hardness of the matrix of the titanium particle is 200 to 600.

20. A titanium material compacted into a predetermined shape by using the titanium powder containing a solid-soluted oxygen according to claim 7.

* * * * *